US008173337B2

(12) United States Patent
Kelly et al.

(10) Patent No.: US 8,173,337 B2
(45) Date of Patent: May 8, 2012

(54) FUSER MATERIAL COMPOSITION COMPRISING OF A POLYMER MATRIX WITH THE ADDITION OF GRAPHENE-CONTAINING PARTICLES

(75) Inventors: Matthew M. Kelly, Webster, NY (US); David J. Gervasi, Pittsford, NY (US); Santokh S. Badesha, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 552 days.

(21) Appl. No.: 12/361,131

(22) Filed: Jan. 28, 2009

(65) Prior Publication Data

US 2010/0190100 A1 Jul. 29, 2010

(51) Int. Cl.
*G03G 15/20* (2006.01)

(52) U.S. Cl. ..... 430/56; 430/57.2

(58) Field of Classification Search ..... 430/56, 430/57.2

See application file for complete search history.

(56) References Cited

U.S. PATENT DOCUMENTS

| | | | | |
|---|---|---|---|---|
| 6,514,650 | B1 * | 2/2003 | Schlueter et al. | 430/56 |
| 2007/0059619 | A1 * | 3/2007 | Shimoyama et al. | 430/58.7 |
| 2008/0038658 | A1 | 2/2008 | Tanaka | |
| 2009/0245840 | A1 | 10/2009 | Law | |
| 2010/0055365 | A1 * | 3/2010 | Nakajima et al. | 428/36.9 |

FOREIGN PATENT DOCUMENTS

| | | |
|---|---|---|
| EP | 1942161 | 7/2008 |
| WO | 2008044643 | 4/2008 |

OTHER PUBLICATIONS

I.W. Frank et al., "Mechanical properties of suspended graphene sheets," J. Vac. Sci. Technol. B 25(6), Nov./Dec. 2007, pp. 2558-2561.

Mikhail I. Katsnelson, "Graphene: carbon in two dimensions," materialstoday, Jan.-Feb. 2007, vol. 10, No. 1-2, pp. 20-27.

Hamish Johnston, "Graphene continues to amaze," Technology Update, May 7, 2008, 3 Pages.

"Controlling Graphene's Electronic Structure," ALSNews, vol. 275, Apr. 25, 2007, 2 Pages, Available at http://www.als.gov/als/science/sci_archive/140graphene.html.

Alexander A. Balandin et al., "Superior Thermal Conductivity of Single-Layer Graphene," Nano Letters, vol. 8, No. 3, 2008, pp. 902-907.

European Patent Office, European Search Report, European Application No. 10151217.6, Apr. 28, 2010, 3 pages.

* cited by examiner

*Primary Examiner* — Mark F Huff
*Assistant Examiner* — Rashid Alam
(74) *Attorney, Agent, or Firm* — MH2 Technology Law Group LLP

(57) ABSTRACT

Exemplary embodiments provide material compositions useful for electrophotographic devices and processes. The material composition can include a plurality of graphene-containing particles dispersed or distributed in a polymer matrix. Such material composition can be used for electrophotographic members and devices including, but not limited to, a fuser member, a fixing member, a pressure roller, and/or a release donor member. In one embodiment, a material composition dispersion can be applied on a substrate in electrophotography to form a functional member layer to control, e.g., to improve, at least one of thermal, mechanical and/or electrical properties.

21 Claims, 3 Drawing Sheets

FUSER MATERIAL COMPOSITION COMPRISING OF A POLYMER MATRIX WITH THE ADDITION OF GRAPHENE-CONTAINING PARTICLES

FIELD OF THE INVENTION

This invention relates generally to material compositions and, more particularly, to graphene-containing material compositions used for electrophotographic devices and processes.

BACKGROUND OF THE INVENTION

Many polymers are not inherently thermally conducting (i.e. Viton GF) and have the potential to improve their thermal conductive properties by introducing fillers into the polymer matrix. In the past, filler materials, including copper particles (or flakes or needles), aluminum oxide, nano-alumina, titanium oxide, silver flakes, aluminum nitride, nickel particles, silicon carbide, and silicon nitride, have been introduced into the polymer matrices in order to improve their thermal conductivities.

Although these thermally conductive polymer matrices have been used in electrophotography, for example, for fusing operation, there is still a great interest in finding other filler materials that would significantly improve the properties of the polymer matrices. For example, composite materials having significantly improved thermal conductivities can reduce run temperatures and can also increase fuser component life. In addition, it is also desired to provide polymer matrices that can reduce paper edge wear of fuser members, since paper edge wear reduces fuser life and causes a high cost.

Thus, there is a need to overcome these and other problems of the prior art and to provide material compositions with improved thermal, mechanical and/or electrical properties for members used in electrophotographic printing devices and processes.

SUMMARY OF THE INVENTION

According to various embodiments, the present teachings include an electrophotographic member that includes a substrate and at least one member layer disposed over the substrate. The at least one member layer can further include a plurality of graphene-containing particles dispersed in a polymer matrix in an amount to control at least a thermal conductivity of the eletrophotographic member.

According to various embodiments, the present teachings also include a method for making an electrophotographic member. In this method, composition dispersion can first be prepared to include a plurality of graphene-containing particles and a polymer. The plurality of graphene-containing particles can be present in an amount to control at least a thermal conductivity of the electrophotographic member. The prepared composition dispersion can then be applied to a substrate and can be solidified over the substrate.

According to various embodiments, the present teachings further include a method for making an electrophotographic member. In this method, a composition dispersion can be prepared by first dissolving a polymer, such as a fluoropolymer, in a solvent and then admixing a plurality of graphene-containing particles therewith. The prepared composition dispersion can be applied to a substrate and then be solidified to form a polymer matrix over the substrate. In the polymer matrix, the plurality of graphene-containing particles is present in an amount from about 1% to about 60% by weight of the polymer matrix.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Figure 1A:
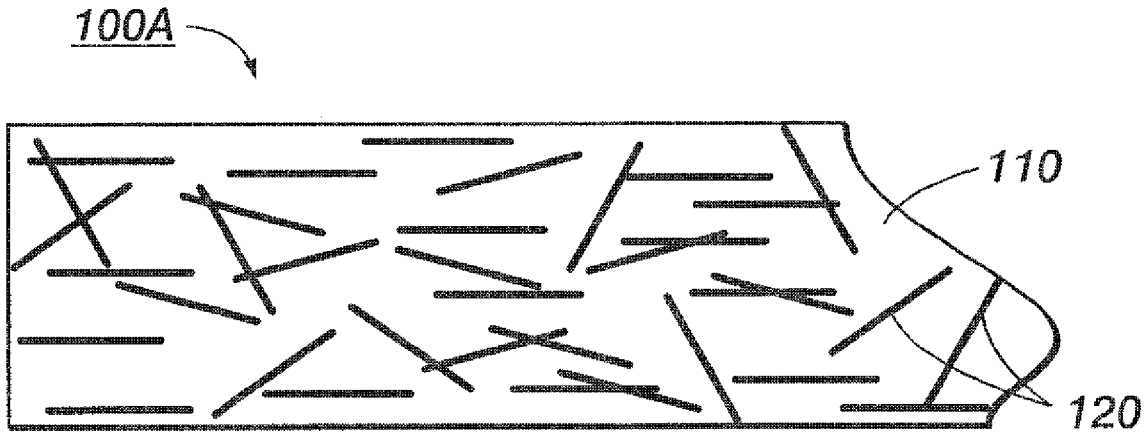
FIG. 1A is a schematic showing an exemplary material composition in accordance with the present teachings.

Reference will now be made in detail to the present embodiments (exemplary embodiments) of the invention, an example of which is illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Exemplary embodiments provide material compositions useful for electrophotographic devices and processes. The material composition can include a plurality of graphene-containing particles dispersed or distributed in a polymer matrix. Such material composition can be used for electrophotographic members and devices including, but not limited to, a fuser member, a fixing member, a pressure roller, and/or a release donor member. In one embodiment, a material composition dispersion can be applied on a substrate in electrophotography to form a functional member layer to control, or improve, at least one of thermal, mechanical and/or electrical properties.

FIG. 1A is a schematic showing an exemplary material composition 100A in accordance with the present teachings. As shown, the material composition 100A can include a plurality of graphene-containing particles 120 dispersed or distributed within a polymer matrix 110. Although the plurality of graphene-containing particles 120 is depicted having a consistent size and shape in FIG. 1A, one of ordinary skill in the art will understand that the plurality of graphene-containing particles 120 can have different sizes, and/or shapes. In addition, it should be readily apparent to one of ordinary skill in the art that the material composition depicted in FIG. 1A represents a generalized schematic illustration and that other particles/fillers/polymers can be added or existing particles/fillers/polymers can be removed or modified.

As used herein, the term "graphene" refers to a single layer of carbon arranged in a graphite structure where carbon is hexagonally arranged to form a planar condensed ring system. The stacking of graphite layers can be, for example, hexagonal or rhombohedral. In some cases, the majority of graphite structures of the graphene can have hexagonal stacking. Carbon atoms in such graphite structures can be generally recognized as being covalently bonded with $sp^2$ hybridization. While the term "graphite" typically refers to planar sheets of carbon atoms with each atom bonded to three neighbors in a honeycomb-like structure that has a three-dimensional regular order, the term "graphite" does not usually include a single layer of bonded carbon due to the lack of three-dimensional bonding of carbon.

Thus, as used herein, the term "graphene" can include, for example, single layers of elemental bonded carbon having graphite structure(s) (including impurities), as well as graphite where carbon is bonded in three-dimensions with multiple layers. The term "graphene" can further include fullerene structures, which are generally recognized as compounds including an even number of carbon atoms, which form a cage-like fused ring polycyclic system with five and six membered rings, including exemplary $C_{60}$, $C_{70}$, and $C_{80}$ fullerenes or other closed cage structures having three-coordinate carbon atoms.

Figure 2A:
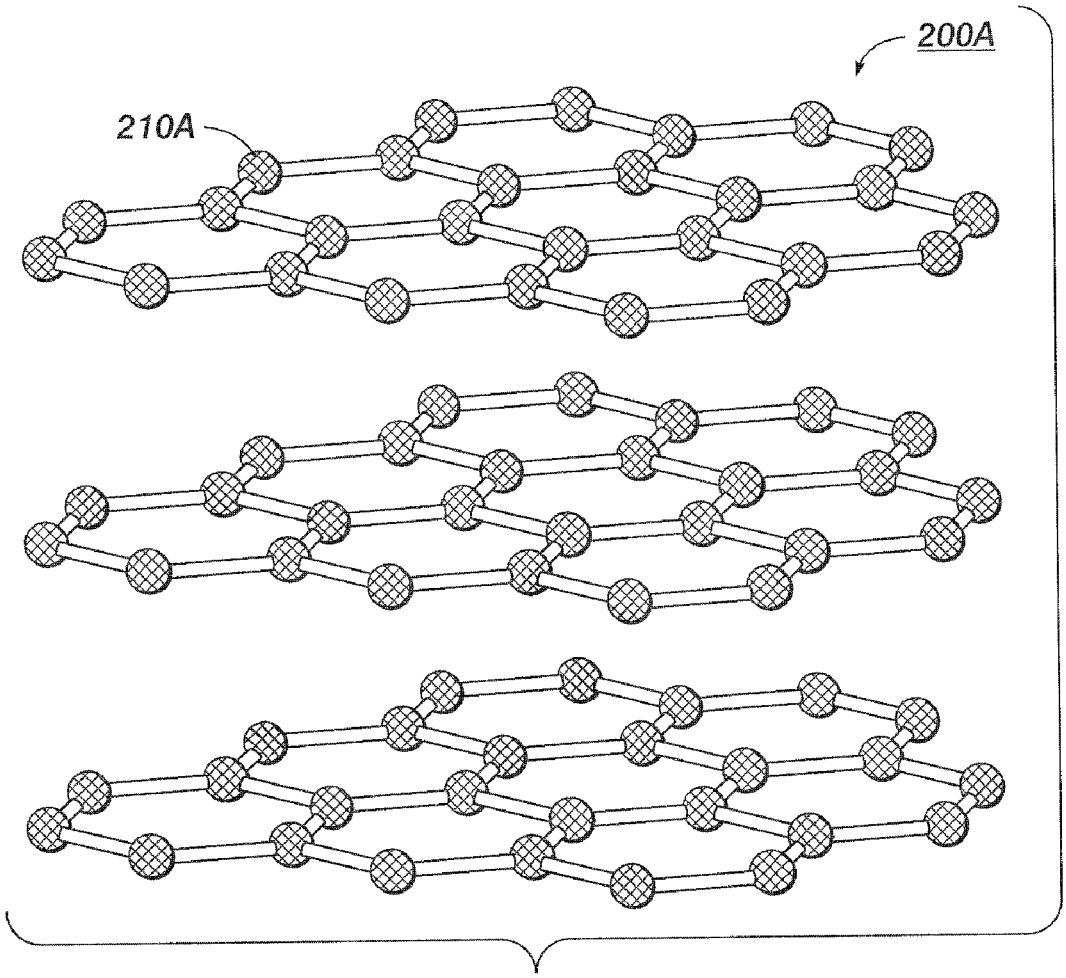
FIG. 2A depicts a schematic for graphite having a three-dimensional atomic crystal structure.
Figure 2B:
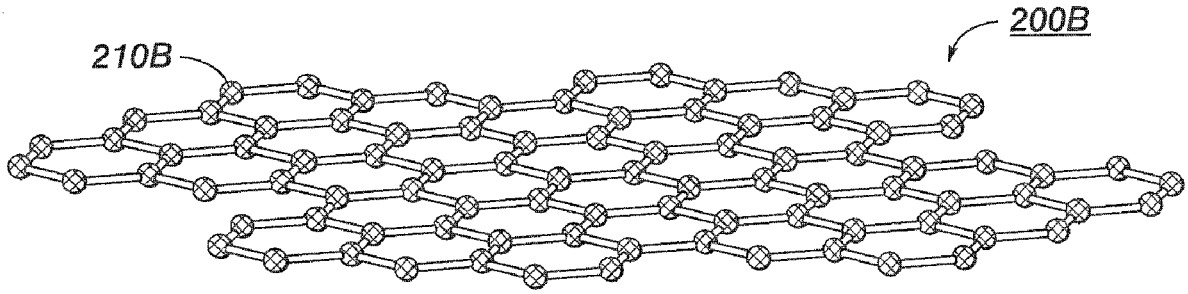
FIG. 2B depicts a schematic for graphene having a two-dimensional atomic crystal structure.

For better understanding of the terms "graphite" and "graphene", FIG. 2A depicts an exemplary schematic for "graphite" having a three-dimensional atomic crystal structure 200A of carbon 210*a*, while FIG. 2B depicts an exemplary schematic for "graphene" having a two-dimensional atomic crystal structure 200B of carbon 210*b* in accordance with the present teachings. The atomic crystal structures for graphite and graphene can also be found in the journal of MaterialsToday, Vol. 10, 2007, entitled "Graphene-Carbon in Two Dimensions," according to various embodiments of the present teachings.

In various embodiments, the graphene-containing particles 120 can be in various forms. For example, the graphene-containing particle 120 can have a nanoparticulate structure that has at least one minor dimension, for example, width or diameter, of about 100 nanometers or less and can be in a form of, such as, for example, nanotube, nanofiber, nanoshaft, nanopillar, nanowire, nanorod, and nanoneedle and their various functionalized and derivatized fibril forms, which include nanofibers with exemplary forms of thread, yarn, fabrics, etc. In various other embodiments, the graphene-containing particle 120 can have a dimension at micro-scale and can be in a form of, for example, whisker, rod, filament, caged structure, buckyball (such as buckminsterfullerene), and mixtures thereof.

In various embodiments, the graphene-containing particles 120 can be soluble fragments of graphene received as, for example, sheets or nanotubes, depending on the chemical modification of its graphite structure which takes place. Further embodiments include, but are not limited to, methods of synthesis by which arc discharge, laser ablation, high pressure carbon monoxide (HiPCO), and chemical vapor deposition (CVD) may be used.

In one exemplary embodiment, the graphene-containing particles 120 can be in a form of carbon nanotubes with tubes or cylinders formed of one or more graphene layers (e.g., flat layers), which is unlike the one-dimensional non-graphene-containing nanotube known in the prior art. For example, the graphene-containing carbon nanotubes can include a single-walled carbon nanotube species (SWNT) including one graphene sheet; or can include a multi-walled carbon nanotube (MWNT) species including multiple layers of graphene sheet, concentrically arranged or nested within one another. In various embodiments, a single-walled nanotube (SWNT) may resemble a flat sheet that has been rolled up into a seamless cylinder, while a multi-walled nanotube (MWNT) may resemble stacked sheets that have been rolled up into seamless cylinders.

In another exemplary embodiment, the graphene-containing particles 120 can be in a form of carbon whiskers with cylindrical filaments where graphene layers are arranged in scroll-like manner with no three-dimensional stacking order.

The plurality of graphene-containing particles 120 can provide many advantages to the graphene-containing material composition 100. For example, due to the flat shape of graphene structure and ability to be integrated with silicon technology, the graphene-containing material can facilitate heat removal from electronics devices. In addition, atomic vibrations of the graphene can be easily moved through its flat structure as compared with other materials, which provides the graphene, for example, a high thermal conductivity. Further, the graphene can be used as electrical charge carriers (e.g., for electrons and/or for holes) to move through a solid with effectively zero mass and constant velocity, like photons. Furthermore, the graphene can possess an intrinsically-low scattering rate from defects, which implies electronics based on the manipulation of electrons as waves rather than particles.

For example, graphenes in its pure form can provide a thermal conductivity of about $4\times10^3$ $Wm^{-1}K^{-1}$ or higher, such as ranging from about $4\times10^3$ $Wm^{-1}K^{-1}$ to about $6\times10^3$ $Wm^{-1}K^{-1}$. This thermal conductivity is much higher as compared with those non-graphene containing materials including non-graphene containing carbon nanotubes, non-graphene containing graphite and/or metals, such as copper and aluminum. In addition, graphenes can provide mechanical robustness (e.g., high strength and rigidity). For example, graphenes can provide a spring constant on the order of about 1 N/m or higher, such as about 1 to 5 N/m, and can provide an exemplary Young's modulus of about 0.5 TPa, which differs from bulk graphite.

Referring back to FIG. 1, the graphene-containing particles 120 can be used as a filler material distributed within the polymer matrix 110 to substantially control, e.g., enhance, the physical properties, such as, for example, thermal conductivities, or mechanical robustness of the resulting polymer matrices. The resulting material can be used as, for example, a fuser material in a variety of fusing subsystems and embodiments.

Various polymers can be used for the polymer matrix 110 to provide desired properties according to specific applications. The polymers used for the polymer matrix 110 can include, but are not limited to, silicone elastomers, fluoroelastomers, fluoroplastics, thermoelastomers, fluororesins, and/or resins. For example, the polymer matrix 110 can include fluoroelastomers, e.g., having a monomeric repeat unit selected from the group consisting of tetrafluoroethylene (TFE), perfluoro(methyl vinyl ether), perfluoro(propyl vinyl ether), perfluoro(ethyl vinyl ether), vinylidene fluoride (VDF or VF2), hexafluoropropylene (HFP), and mixtures thereof.

Commercially available fluoroelastomers can include, for example, such as Viton A® (copolymers of hexafluoropropylene (HFP) and vinylidene fluoride (VDF or VF2)), Viton®-B, (terpolymers of tetrafluoroethylene (TFE), vinylidene fluoride (VDF) and hexafluoropropylene (HFP); and Viton®-GF, (tetrapolymers including TFE, VF2, HFP)), as well as Viton E®, Viton E 60C®, Viton E430®, Viton 910®, Viton GH® and Viton GF®. The Viton® designations are Trademarks of E.I. DuPont de Nemours, Inc. Still other commercially available fluoroelastomer can include, for example, Dyneon™ fluoroelastomers from 3M Company.

Other commercially available fluoropolymers can include, for example, Fluorel 2170®, Fluorel 2174®, Fluorel 2176®, Fluorel 2177® and Fluorel LVS 76®, Fluorel® being a Trademark of 3M Company. Additional commercially available materials can include Aflas® a poly(propylene-tetrafluoroethylene) and Fluorel II® (LII900) a poly(propylene-tetrafluoroethylenevinylidenefluoride) both also available from 3M Company, as well as the Tecnoflons identified as For-60KIR®, For-LHF®, NM®, For-THF®, For-TFS®, TH®, and TN505®, available from Solvay Solexis.

In various embodiments, the polymer matrix 120 can include a fluororesin selected from the group consisting of polytetrafluoroethylene, copolymer of tetrfluoroethylene and hexafluoropropylene, copolymer of tetrafluoroethylene and perfluoro(propyl vinyl ether), copolymer of tetrafluoroethylene and perfluoro(ethyl vinyl ether), and copolymer of tetrafluoroethylene and perfluoro(methyl vinyl ether).

In various embodiments, the polymer matrix 110 can include fluoroplastics including, but not limited to, PFA (polyfluoroalkoxypolytetrafluoroethylene), PTFE (polytetrafluoroethylene), or FEP (fluorinated ethylenepropylene copolymer). These fluoropolymers can be commercially available from various designations, such as Teflon® PFA, Teflon® PTFE, Teflon® FEP.

In various embodiments, the polymer matrix 120 can include polymers cross-linked with an effected cross-linking agent (also referred to herein as cross-linker or curing agent). For example, when the polymer matrix includes a vinylidene-fluoride-containing fluoroelastomer, the curing agent can incude, a bisphenol compound, a diamino compound, an aminophenol compound, an amino-siloxane compound, an amino-silane or a phenol-silane compound. An exemplary bisphenol cross-linker can be Viton® Curative No. 50 (VC-50) available from E. I. du Pont de Nemours, Inc. VC-50 can be soluble in a solvent suspension and can be readily available at the reactive sites for cross-linking with, for example, Viton-GF® (E. I. du Pont de Nemours, Inc.), including tetrafluoroethylene (TFE), hexafluoropropylene (HFP), and vinylidene fluoride (VF2).

Figure 1B:
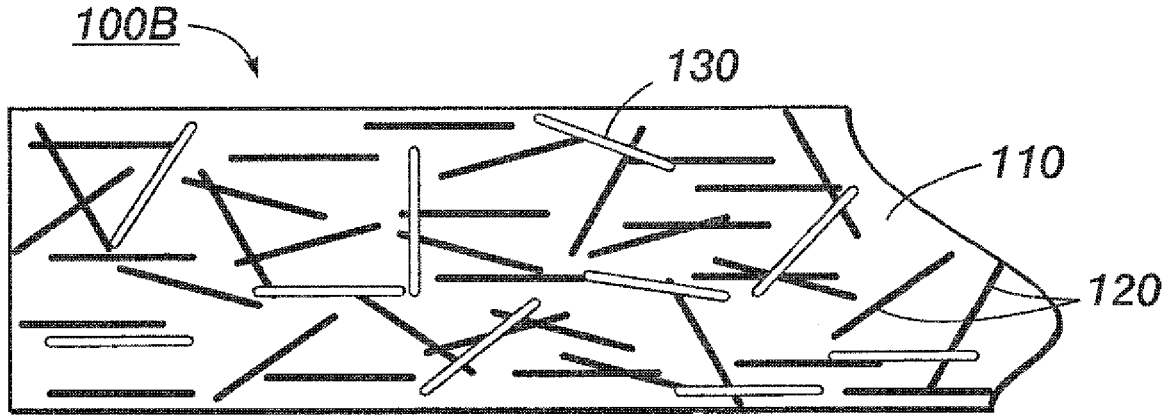
FIG. 1B is a schematic showing another exemplary material composition in accordance with the present teachings.

Various other fillers, such as conventional filler materials, can also be used in the disclosed material composition, as shown in FIG. 1B. In FIG. 1B, a plurality of non-graphene fillers 130 can be additionally dispersed/distributed within the polymer matrix 110 along with the disclosed graphene-containing particles 120 as similarly described in FIG. 1A.

In various embodiments, the non-graphene fillers 130 can be in a dimensional scale of micron or nano-scale. The non-graphene fillers 130 can be organic, inorganic or metallic. In various embodiments, the non-graphene fillers 130 can include conventional fillers for composite materials, such as, for example, copper particles, copper flakes, copper needles, aluminum oxide, nano-alumina, titanium oxide, silver flakes, aluminum nitride, nickel particles, silicon carbide, silicon nitride, etc. In various embodiments, any number of combinations the graphene-containing particles 120 and the non-graphene fillers 130 can be contemplated by the present disclosure, so long as at least one of them includes a graphene-containing particle.

Figure 3:
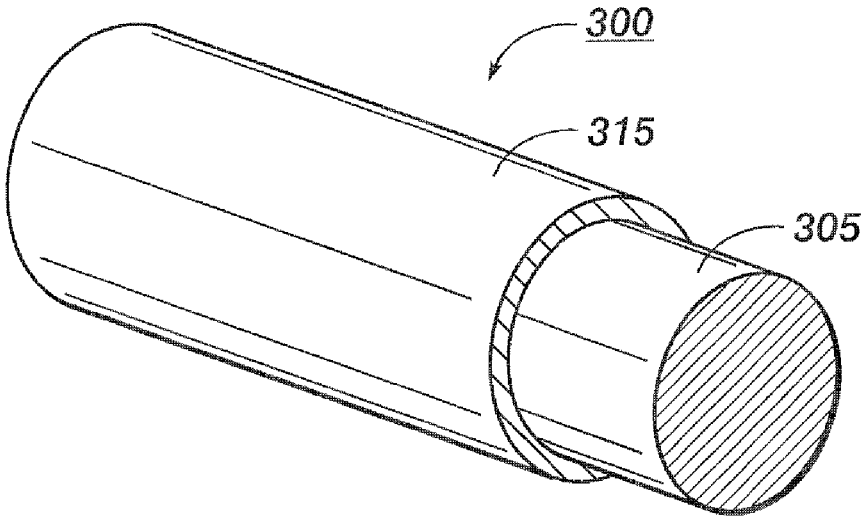
FIG. 3 depicts an exemplary electrophotographic member using the material compositions of FIGS. 1A-1B in accordance with the present teachings.

In various embodiments, the disclosed material composition 100 can be used for any suitable electrophotographic members and devices. For example, FIG. 3 depicts an exemplary electrophotographic member 300 in accordance with the present teachings. It should be readily apparent to one of ordinary skill in the art that the member 300 depicted in FIG. 3 represents generalized schematic illustrations and that other particles/layers/substrates can be added or existing particles/layers/substrates can be removed or modified.

In various embodiments, the member 300 can be, for example, a fuser member, a fixing member, a pressure member, a donor member useful for electrophotographic devices. The member 300 can be in a form of for example, a roll, a belt, a plate or a sheet. As shown in FIG. 3, the member 300 can include, a substrate 305 and at least one member layer 315 formed over the substrate 305.

In various embodiments, the member 300 can be a fuser roller including at least one member layer 315 formed over an exemplary core substrate 305. In various embodiments, the core substrate can take the form of a cylindrical tube or a solid cylindrical shaft. One of ordinary skill in the art will understand that other substrate forms, e.g., a belt substrate, can be used to maintain rigidity, structural integrity of the member 300.

The member layer 315 can include, for example, the material composition 100 as shown in FIGS. 1A-1B. The member layer 315 can thus include a plurality of graphene-containing particles, and optionally non-graphene fillers such as metals or metal oxides, dispersed within a polymer matrix as disclosed herein. As shown, the member layer 315 can be formed directly on the substrate 305. In various embodiments, one or more additional functional layers, depending on the member applications, can be formed over the member layer 125 and/or between the member layer 315 and the substrate 305.

In an exemplary embodiment, the member 300 can have a 2-layer configuration having a compliant/resilient layer, such as a silicone rubber layer, disposed between the member layer 315 and the core substrate 305, such as a metal used in the related art. In another exemplary embodiment, the member 300 can include a surface layer, for example, including a fluoropolymer, formed over the member layer 315 that is formed over a resilient layer or the substrate 305.

Figure 4:
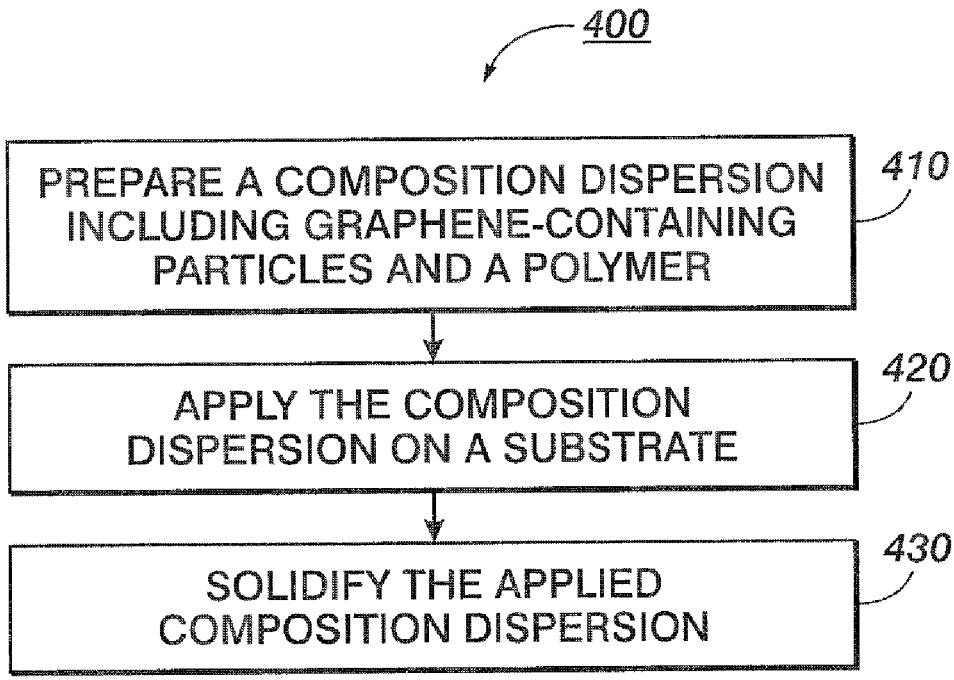
FIG. 4 depicts a method for forming an exemplary fuser member using the material compositions of FIGS. 1A-1B in accordance with the present teachings.

Various embodiments can also include methods for forming the disclosed material composition (see FIGS. 1A-1B) and for forming the electrophotographic member (see FIG. 3). FIG. 4 depicts a method for forming an exemplary fuser member in accordance with present teachings. Note that while the method 300 of FIG. 4 is illustrated and described below as a series of acts or events, it will be appreciated that the present invention is not limited by the illustrated ordering of such acts or events. For example, some acts may occur in different orders and/or concurrently with other acts or events apart from those illustrated and/or described herein. Also, not all illustrated steps may be required to implement a methodology in accordance with one or more aspects or embodiments of the present invention. Further, one or more of the acts depicted herein may be carried out in one or more separate acts and/or phases.

At 410 in FIG. 4, a composition dispersion can be prepared to include, for example, a polymer of interest (e.g., Viton GF) as disclosed herein and graphene-containing particles in a suitable solvent depending on the polymer used. Various solvents including, but not limited to, water, methyl ethyl ketone (MEK), methyl isobutyl ketone (MIBK), methyl-tertbutyl ether (MTBB), methyl n-amyl ketone (MAK), tetrahydrofuran (THF), Alkalis, methyl alcohol, ethyl alcohol, acetone, ethyl acetate, butyl acetate, or any other low molecular weight carbonyls, polar solvents, fireproof hydraulic fluids, along with the Wittig reaction solvents such as dimethyl formamide (DMF), dimethyl sulfoxide (DMSO) and N-methyl 2 pyrrolidone (NMP), can be used to prepare the composition dispersion.

For example, the composition dispersion can be formed by first dissolving the polymer in a suitable solvent, followed by adding a plurality of graphene-containing particles into the solvent in an amount to provide desired properties, such as a desired thermal conductivity or mechanical strength. In an exemplary embodiment, the composition dispersion can include graphene of about 1% to about 60% by weight of the polymer matrix for an enhanced thermal conductivity.

In various embodiments, when preparing the composition dispersion, a mechanical process, such as an agitation, sonication or attritor ball milling/grinding, can be used to facilitate the mixing of the dispersion. For example, an agitation set-up fitted with a stir rod and Teflon blade can be used to thoroughly mix the graphene-containing particles with the polymer in the solvent, after which additional chemical curatives, such as curing agent, and optionally other non-graphene fillers such as metal oxides, can be added into the mixed dispersion.

At 420, an electrophotographic member, such as a fuser member, can be formed by applying an amount of the composition dispersion (e.g., that includes a desired polymer and its curing agent, a plurality of graphene-containing particles and optionally inorganic fillers in a solvent) to a substrate, such as the substrate 305 in FIG. 3. The application of the composition dispersion to the substrate can be, for example, deposition, coating, molding or extrusion. In an exemplary embodiment, the composite dispersion, i.e., the reaction mixture, can be spray coated, flow coated, injection molded onto the substrate.

At 430, the applied composition dispersion can then be solidified, e.g., be cured, to form a member layer, e.g., the layer 315, on the substrate, e.g., the substrate 305 of FIG. 3. The curing process can include, for example, a drying process and/or a step-wise process including temperature ramps. Depending on the composition dispersion, various curing schedules can be used. In various embodiments, following the curing process, the cured member can be cooled, e.g., in a water bath and/or at a room temperature.

In various embodiments, the formed fuser member can have desired properties including thermal conductivity, mechanical strength, and other physical properties, such as wear performance, or release performance. In various embodiments, additional functional layer(s) can be formed prior to or following the formation of the member layer over the substrate depending on the electrophotographic devices and processes.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electrophotographic member comprising:

a substrate; and at least one member layer disposed over the substrate; wherein the at least one member layer comprises a plurality of graphene-containing particles dispersed in a fluoropolymer matrix in an amount ranging from about 1% to about 60% by weight of the fluoropolymer matrix to control at least a thermal conductivity of the eletrophotographic member.

2. The member of claim 1, wherein each particle of the plurality of graphene-containing particles comprises a nanotube, a nanofiber, a nanoshaft, a nanopillar, a nanowire, a nanorod, a nanoneedle, a nanofiber and mixtures thereof.

3. The member of claim 1, wherein each particle of the plurality of graphene-containing particles comprises a single wall carbon nanotube (SWCNT), a multi-wall carbon nanotube (MWCNT) and mixtures thereof.

4. The member of claim 1, wherein each particle of the plurality of graphene-containing particles comprises a whisker, a fiber, a rod, a filament, a tube, a caged structure, a buckyball, and mixtures thereof.

5. The member of claim 1, wherein the plurality of graphene-containing particles comprises a thermal conductivity of about $4\times10^3$ $Wm^{-1}K^{-1}$ or higher.

6. The member of claim 1, wherein the plurality of graphene-containing particles has a spring constant of about 1 N/m or higher.

7. The member of claim 1, wherein the fluoropolymer matrix further comprises silicone elastomers, thermoelastomers, or resins.

8. The member of claim 1, wherein the fluoropolymer matrix comprises a fluoroelastomer having a monomeric repeat unit selected from the group consisting of tetrafluoroethylene, perfluoro(methyl vinyl ether), perfluoro(propyl vinyl ether), perfluoro(ethyl vinyl ether), vinylidene fluoride, hexafluoropropylene, and mixtures thereof.

9. The member of claim 1, wherein the fluoropolymer matrix comprises a vinylidene fluoride-containing fluoroelastomer cross-linked with a curing agent that is selected from a group consisting of a bisphenol compound, a diamino compound, an aminophenol compound, an amino-siloxane compound, an amino-silane, and phenol-silane compound.

10. The member of claim 1, wherein the fluoropolymer matrix comprises a fluororesin selected from the group consisting of polytetrafluoroethylene, copolymer of tetrafluoroethylene and hexafluoropropylene, copolymer of tetrafluoroethylene and perfluoro(propyl vinyl ether), copolymer of tetrafluoroethylene and perfluoro(ethyl vinyl ether), and copolymer of tetrafluoroethylene and perfluoro(methyl vinyl ether).

11. The member of claim 1, further comprising one or more non-graphene filler particles dispersed in the polymer matrix, wherein the one or more non-graphene filler particles comprise metals, or metal oxides.

12. The member of claim 1, wherein the substrate is in a form of a cylinder, a belt or a sheet.

13. A method for making an electrophotographic member comprising:

forming a composition dispersion comprising a plurality of graphene-containing particles and a fluoropolymer, wherein the plurality of graphene-containing particles are provided in an amount ranging from about 1% to about 60% by weight of the fluoropolymer to control at least a thermal conductivity of the electrophotographic member;

applying the formed composition dispersion to a substrate; and solidifying the applied composition dispersion over the substrate to form the electrophotographic member.

14. The method of claim 13, wherein the composition dispersion further comprises a cross-linking agent for cross-linking the polymer, and optionally a plurality of non-graphene filler particles dispersed in a solvent.

15. The method of claim 13, wherein each particle of the plurality of graphene-containing particles comprises a nanotube, a nanofiber, a nanoshaft, a nanopillar, a nanowire, a nanorod, a nanoneedle, a nanofiber, a whisker, a fiber, a rod, a filament, a tube, a caged structure, a buckyball, and mixtures thereof.

16. The method of claim 13, wherein the plurality of graphene-containing particles is present in an amount from about 1% to about 60% by weight of the polymer.

17. The method of claim 13, wherein the fluoropolymer is selected from the group consisting of fluoroelastomers, fluororesins, fluoroplastics and combinations thereof.

18. The method of claim 13, wherein the substrate is in a form of a cylinder, a belt or a sheet.

19. An electrophotographic member formed by the method of claim 13, wherein the electrophotographic member comprises a fuser member, a fixing member, a pressure member, or a release donor member.

20. A method for making an electrophotographic member comprising:

dissolving a fluoropolymer in a solvent;

forming a composition dispersion by admixing a plurality of graphene-containing particles with the solvent containing the fluoropolymer;

applying the formed composition dispersion to a substrate; and solidifying the applied composition dispersion to form a fluoropolymer matrix over the substrate, wherein the plurality of graphene-containing particles is present in the fluoropolymer matrix in an amount from about 1% to about 60% by weight of the fluoropolymer matrix.

21. The member of claim 1, wherein the fluoropolymer matrix comprises one or more fluoropolymers selected from the group consisting of a fluoroelastomer, a fluororesin, a fluoroplastic, and a combination thereof.

* * * * *